US008065819B2

(12) United States Patent
Kaufman

(10) Patent No.: US 8,065,819 B2
(45) Date of Patent: Nov. 29, 2011

(54) HANDS-FREE STEP-IN CLOSURE APPARATUS

(76) Inventor: Steven Kaufman, New York City, NY (US)

( * ) Notice: Subject to any disclaimer, the term of this patent is extended or adjusted under 35 U.S.C. 154(b) by 751 days.

(21) Appl. No.: 12/172,609

(22) Filed: Jul. 14, 2008

(65) Prior Publication Data

US 2009/0223084 A1 Sep. 10, 2009

Related U.S. Application Data

(60) Provisional application No. 61/068,145, filed on Mar. 5, 2008.

(51) Int. Cl.
*A43B 5/00* (2006.01)
*A43C 11/00* (2006.01)

(52) U.S. Cl. ..... 36/50.1; 36/50.5; 36/138; 36/122

(58) Field of Classification Search ..... 36/11.5, 36/50.1, 50.5, 138, 122
See application file for complete search history.

(56) References Cited

U.S. PATENT DOCUMENTS

| | | | | | |
|---|---|---|---|---|---|
| 2,452,649 | A | * | 11/1948 | Graves | 36/138 |
| 3,146,535 | A | * | 9/1964 | Owings | 36/7.3 |
| 4,403,790 | A | | 9/1983 | Bauer et al. | |
| 4,429,896 | A | | 2/1984 | Spademan | |
| 4,907,352 | A | | 3/1990 | Ginsberg | |
| 5,054,216 | A | * | 10/1991 | Lin | 36/138 |
| 5,282,327 | A | * | 2/1994 | Ogle | 36/138 |
| 5,362,087 | A | | 11/1994 | Agid | |
| 5,481,814 | A | * | 1/1996 | Spencer | 36/138 |
| 5,722,680 | A | * | 3/1998 | Dodge | 280/624 |
| 5,779,259 | A | | 7/1998 | Lin | |
| 5,941,555 | A | * | 8/1999 | Dodge | 280/623 |
| 5,954,358 | A | * | 9/1999 | Bejean et al. | 280/627 |
| 5,983,530 | A | * | 11/1999 | Chou | 36/50.1 |
| 6,018,890 | A | | 2/2000 | Bowen | |
| 6,427,361 | B1 | * | 8/2002 | Chou | 36/50.1 |

(Continued)

FOREIGN PATENT DOCUMENTS

EP 1059044 12/2000

(Continued)

OTHER PUBLICATIONS

International Search Report and Written Opinion of the International Searching Authority mailed by the U.S. Receiving Office on Sep. 1, 2009 for co-pending International Appl. No. PCT/US 09/49946.

*Primary Examiner* — Marie Patterson
(74) *Attorney, Agent, or Firm* — Leason Ellis LLP

(57) ABSTRACT

A hands-free fastening mechanism for releasably securing a user's foot to footwear is disclosed. The fastening mechanism comprises at least one pivotable strap which is coupled to a hinge mechanism which, in turn, is secured to the footwear. The hinge mechanism allows the strap to pivot between an open and a closed position. The strap is further coupled to a lever which is engageable by a user's foot so as to cause the strap to move from the open position to the closed position. When the strap moves to the closed position, a catch will engage, thereby securing the user's foot within the footwear. The footwear may then be removed by using the other foot to apply pressure to a protruding member and then withdrawing the secured foot such that the catch is disengaged and the foot is released.

18 Claims, 10 Drawing Sheets

U.S. PATENT DOCUMENTS

| | | | | |
|---|---|---|---|---|
| 6,575,489 | B1 | 6/2003 | White | |
| 6,643,954 | B2 * | 11/2003 | Voswinkel | 36/50.1 |
| 6,684,534 | B2 * | 2/2004 | Dodge | 36/122 |
| 6,880,270 | B2 | 4/2005 | Prather | |
| 6,983,952 | B2 | 1/2006 | Golling | |
| 7,047,673 | B2 * | 5/2006 | Dodge | 36/122 |
| 7,059,069 | B2 * | 6/2006 | Raluy et al. | 36/105 |
| 7,178,270 | B2 * | 2/2007 | Hurd et al. | 36/92 |
| 2005/0198867 | A1 * | 9/2005 | Labbe | 36/50.1 |
| 2007/0152426 | A1 | 7/2007 | Resch et al. | |
| 2007/0209234 | A1 * | 9/2007 | Chou | 36/50.1 |

FOREIGN PATENT DOCUMENTS

| | | |
|---|---|---|
| EP | 1593315 | 5/2008 |

* cited by examiner

HANDS-FREE STEP-IN CLOSURE APPARATUS

CROSS-REFERENCE TO RELATED APPLICATIONS

This application claims priority to U.S. Provisional Patent Application No. 61/068,145 filed on Mar. 5, 2008 under 35 U.S.C. §119(e), the entirety of which is incorporated herein by reference as if fully set forth herein.

BACKGROUND

1. Field of the Disclosure

This disclosure relates generally to the field of foot bindings. In particular, the present disclosure relates to a hands-free mechanism suitable for securing and releasing an article about a user's foot.

2. Description of the Related Art

Over the course of human history there has been a continuing and ever-present need to utilize various types of footwear suitable for differing purposes. For example, athletic shoes typically comprise a rubber sole combined with a lightweight, breathable mesh upper; work boots are frequently made of a tough rubber sole, leather upper, and are reinforced with a steel toe; and sandals have an open-toe design, consisting merely of some form of sole accompanied by straps to secure the sole to the user's foot. No matter its design or intended purpose, any footwear must include a manner of securely fastening or binding the article to the foot.

A number of fastening devices and methods are presently utilized with the preferred manner of securing the various types of footwear to the user's feet being dependent on the specific application, environmental considerations, the user's preferences, and the physical capabilities of the user. Traditional securing mechanisms include the utilization of shoelaces, zippers, Velcro, buttons, hook and loop fasteners, snaps, and ropes. However, each of these fasteners typically requires the use of one's hands for efficient operation.

The process of securing footwear to the user's feet also requires a certain degree of dexterity, physical maneuverability, and flexibility. This may pose a problem for individuals who are physically challenged such as the elderly, handicapped, or disabled. Furthermore, there exists a desire for persons of ordinary ability to be able to quickly and easily fasten and/or unfasten footwear by means of hands-free operation. Such capability may be desirable merely for convenience, for use in emergency situations, or under hazardous conditions.

SUMMARY

In view of the above-described problems, it is an object of the present disclosure to provide a means of quickly and securely fastening footwear to a user's feet via a simple, reversible, and hands-free operating mechanism. This is accomplished by a fastening device which secures and releases a pivotally movable strap by means of a simple stepping motion of the user's foot. Such a device is advantageous in terms of ease of use, speed of insertion/removal of the foot, and availability of hands-free operation.

In one embodiment, these advantages are realized by means of a foot fastening device configured for use with an article of footwear. The foot fastening device comprises a pair of pivotally movable straps and a pair of movable levers. Each lever is coupled to one of the straps and is engageable by a part of a foot so as to cause the straps to move from an open position to a closed position when engaged by the part of the foot. At least one catch on at least one of the straps in the pair is positioned to releasably connect the pair of straps together.

Another embodiment relates to an article for use with footwear comprising a sole and a foot fastening device coupled to the sole. The foot fastening device comprises at least one pivotally movable strap and a support bracket coupled to the strap to allow the strap to move between a first position and a second position. A movable lever is coupled to the strap, being positioned relative to the sole such that when engaged by a part of a foot, it will cause the strap to move from the first position to the second position. At least one catch is affixed to at least one strap such that, when the catch is engaged, the foot is restrained within the footwear and, when the catch is disengaged, the foot can be removed from the footwear.

An additional embodiment relates to a foot fastening device configured to be attached to an article of footwear. The fastening device comprises at least one pivotally movable strap and a support bracket coupled to the pivotally movable strap to allow the strap to move between a first position and a second position. A movable lever is also coupled to the strap and positioned such that when engaged by a part of a foot it will cause the strap to move from the first position to the second position. At least one catch is affixed to at least one strap such that, when the catch is engaged, the foot is restrained within the footwear and, when the catch is disengaged, the foot can be removed from the footwear.

Still another embodiment relates to a fastening device comprising pivotally movable straps capable of moving between an open and closed position by rotating about an axis located between an upper and lower portion of the strap. The straps are attached to horizontally oriented hinge rods located at opposite ends of a U-shaped support bracket positioned within the footwear. The straps are able to rotate a minimum of 90° such that when a user's foot steps into and thereby rotates the lower portions downward, the upper portions rotate upwards and inwards such that their distal ends engage with each other above the user's mid-foot and secure the foot within the footwear. The foot may then be removed by immobilizing the footwear and then lifting up on the foot to disengage the straps such that the distal ends of the upper portions rotate outwards, thereby releasing the foot.

Yet another embodiment relates to a fastening device wherein the straps comprise upper and lower portions which pivot about a vertical axis. The straps are attached to vertically oriented hinge rods which are located at opposite ends of a U-shaped support bracket positioned within the footwear. The user engages the straps and secures the footwear by moving the foot forwards such that the lower portions rotate forwards while the upper portions rotate backwards and inwards such that their distal ends engage with each other behind the Achilles tendon of the foot and securely fasten the user's foot within the footwear. The user's foot may then be removed by immobilizing the footwear and then moving the foot backwards to disengage the straps such that the distal ends of the upper portions rotate outwards, thereby releasing the foot.

A further embodiment relates to a fastening device wherein the straps are affixed by means of hinge rods to support brackets which are built directly into the footwear. The straps may be removed from the footwear by disengaging the hinge rods.

Another embodiment relates to a hands-free fastening device which reversibly secures the footwear by means of a catch which engages by way of permanent magnets with opposing polarities or a mechanical interlocking device.

An additional embodiment relates to a hands-free fastening device wherein when the straps are not engaged they are maintained in the open position by means of a spring or elastic member.

A further embodiment relates to a hands-free fastening device wherein a user's foot steps down onto a hinged in-sole which in-turn engages a movable lever that will cause the strap to move from the first position to the second position.

Another embodiment relates to footwear comprising multiple hands-free fastening devices to more securely attach the footwear to the user's foot.

DETAILED DESCRIPTION

Figure 1A:
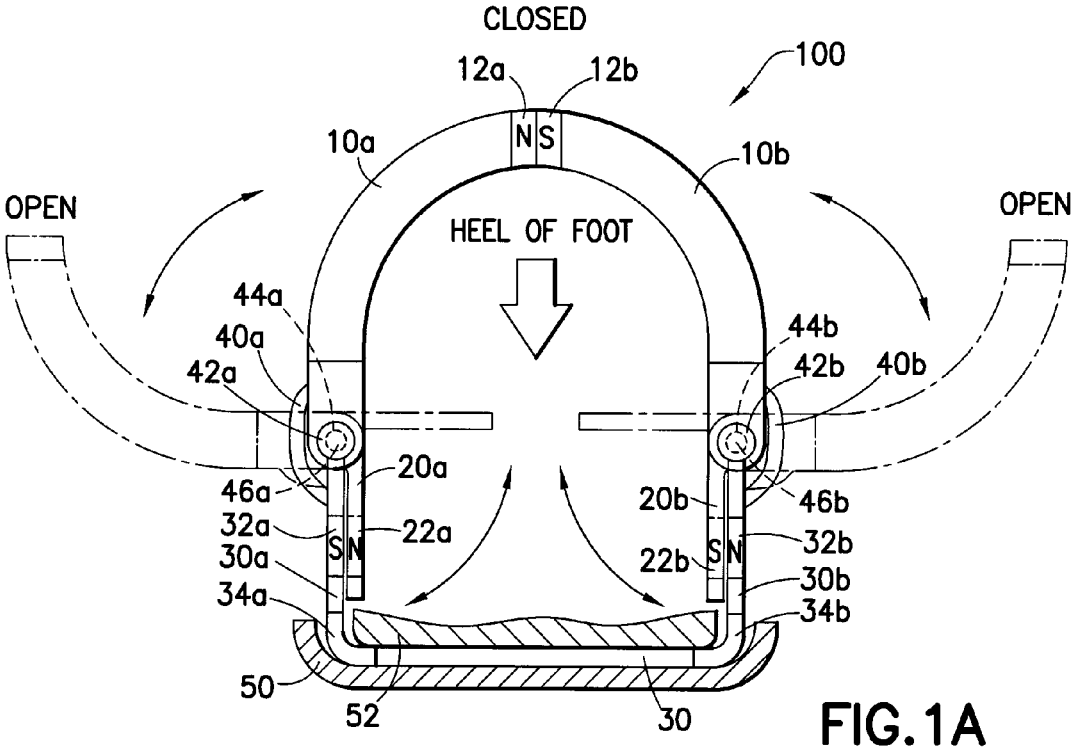
FIG. 1A is a cross-sectional schematic showing a rear view of a first embodiment of the fastening device which illustrates the basic mode of operation.

The above and other objectives of the disclosure will become more apparent from the following description and illustrative embodiments which are described in detail with reference to the accompanying drawings. Similar elements in each figure are designated by like reference numbers and, hence, subsequent detailed descriptions thereof may be omitted for brevity.

The present disclosure is directed to a hands-free step-in closure apparatus for shoes. Thus, as the name implies, this apparatus is capable of securing and releasing footwear to a user's foot by an operating mechanism which can be engaged and disengaged without the use of one's hands. The general operative concept is the utilization of a strap which pivots between an open and closed position by rotating about a hinge in response to the application of a force to a lever. Since this is a hands-free mechanism, the force required to activate the lever is generally applied using one's foot. The lever itself is coupled to the strap such that when the lever is moved the strap also moves. By applying a force to the lever, the strap is moved along a path which puts it in a position to secure the user's foot to the footwear.

In securing the foot it is also necessary to have some type of catch which engages and remains engaged with sufficient force to maintain the footwear on the user's foot amidst its normal use. Even so, the catch should not be of such strength that it cannot be disengaged without the use of one's hands. Therefore the catch may take the form of oppositely aligned permanent magnets of appropriate strength or may be some form of mechanical interlocking device. The catch itself may also be of adjustable strength to enable the user to vary the force required to remove the footwear. This may be accomplished, for example, by configuring the device such that the magnets can be replaced with others with lesser or greater strength.

When the footwear is not in use the fastening device may be such that it is maintained in an open position, thereby allowing quick and easy access to a user who may desire to literally jump into the footwear. The strap and lever may be maintained in an open position by any of a number of spring mechanisms which are well-known in the art. The strength of the spring must be such that the straps remain open and the levers are in a position to be engaged by the user, yet they should not be so strong as to require undue exertion on the part of the user in order to fasten the shoes to the user's feet. The spring mechanism also should not be such that it opposes the holding strength of the mechanical interlocking device to such an extent that it significantly weakens its securing power. If, however, the fastening device is maintained in a closed position when not in use, the user may first disengage the straps and then engage the straps again in the manner as described above.

The various articles which constitute the fastening device including the straps, support brackets, hinge assembly, and levers should be constructed of material sturdy enough to perform the desired operation while withstanding normal wear and maintaining the comfort of the user. Thus, the strap, hinge, and lever may each be constructed from, but are not limited to a polymer, metal, metal alloy, or composite material depending on the specific combination of features desired. Furthermore, the operating mechanism should be simple to facilitate ease of use, yet robust enough to endure repetitive movement between an open and closed position.

The above general description provides an overall picture of the operation of the fastening device. The scope of the device's functionality will become clearer upon consideration of the following illustrative embodiments which, when taken in conjunction with FIGS. 1-8, explain the operating principle in greater detail.

First Embodiment

FIG. 1A is a schematic showing a rear view of a first embodiment of a fastening device 100. The fastening device 100 shown in FIG. 1A comprises two straps 10*a* and 10*b* which are positioned on the left and right side of the user's foot, respectively. The straps are individually affixed to left 20*a* and right 20*b* levers which are, in turn, secured to corresponding left 30*a* and right 30*b* arms of a support bracket 30 (which, in this embodiment, is U-shaped) by means of a hinge rod (46*a* and 46*b* which passes through a hinge located on each lever. The hinge rods are, in turn, secured to the support bracket by attachment points located on the end of each arm of the support bracket. Thus lever 20*a* is attached to arm 30*a* by hinge rod 46*a* which passes through hinge 44*a* and is secured at attachment points 42*a*. Likewise, lever 20*b* is attached to arm 30*b* by hinge rod 46*b* which passes through hinge 44*b* and is secured at attachment points 42*b*.

The combined strap/lever components (10*a*-20*a* and 10*b*-20*b*) rotate about their respective hinge rod (46*a* and 46*b*) when a force is applied to the levers. The hinge rods 46*a* and 46*b* are positioned such that they are approximately parallel with the base of the support bracket 30 (i.e., oriented approximately horizontal with respect to the ground). The spatial alignment between each strap and its corresponding lever is such that a rotation of approximately 90° between a closed (dark lines) and open (dotted lines) position is permitted. When in the open position the levers 20*a* and 20*b* are approximately parallel with the plane formed by the base of the support bracket 30 whereas in the closed position the levers 20*a* and 20*b* are approximately perpendicular with the plane formed by the base of the support bracket 30. Furthermore, when in the closed position, the levers 20*a* and 20*b* are approximately parallel with the arms 30*a* and 30*b* of the support bracket and the distal ends of the straps 10*a* and 10*b* come into contact with each other.

Straps 10*a* and 10*b* and their corresponding lever 20*a* and 20*b* are each equipped with a permanent magnet at their distal ends. Thus, the left 10*a* and right 10*b* straps have magnets 12*a* and 12*b*, respectively, situated at their distal ends. Likewise, levers 20*a* and 20*b* have magnets 22*a* and 22*b*, respectively, positioned at their distal ends. The support bracket 30 further comprises permanent magnets 32*a* and 32*b* positioned approximately midway along arms 30*a* and 30*b*, respectively, such that they are horizontally aligned with corresponding magnet 22*a* on the left lever 20*a* and 22*b* on the right lever 20*b* when the device is in its closed position.

The fastening device 100 therefore comprises three sets of mating magnets, namely 32*a*-22*a*, 12*a*-12*b*, and 22*b*-32*b*. Each set is designed such that they have opposing polarities on a mating side, thereby generating an attractive force capable of holding the straps together when in the closed position. When the magnets are disengaged, straps 10*a* and 10*b* are maintained in the open position by means of elongated elastic members 40*a* and 40*b*. As illustrated in FIG. 1A, elastic member 40*a* has one end attached to the outside of arm 30*a* on the left side of the support bracket 30 with the other end attached to the bottom of the left strap 10*a*. Elastic member 40*b* is attached in a similar manner on the right side. The length and elasticity of the elastic members 40*a* and 40*b* are such that when the magnets are disengaged sufficient tensile force is applied to pull the straps 10*a* and 10*b* apart and maintain them in an open position.

Figure 1B:
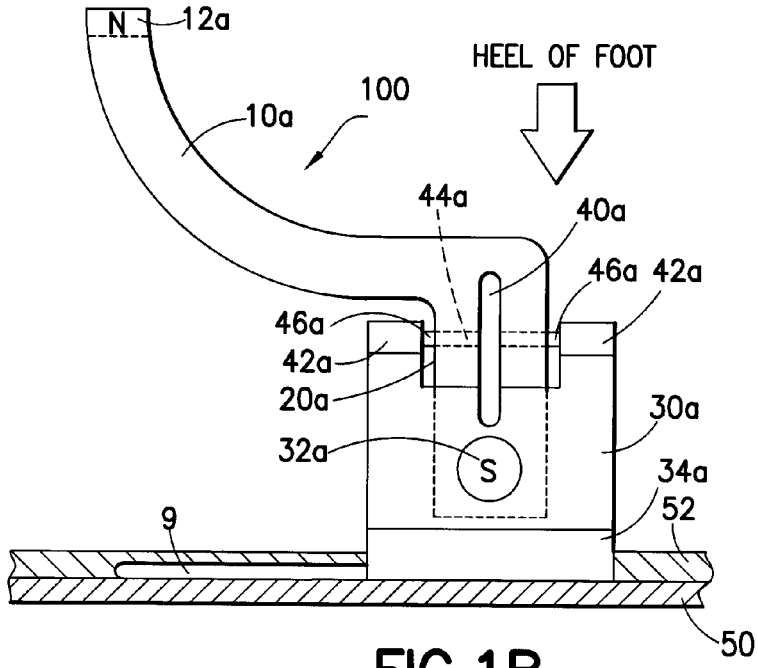
FIG. 1B is a schematic showing a side view of the first embodiment with the straps in a closed position.

A side view of the fastening device 100 is shown in FIG. 1B which illustrates that the support bracket 30 comprises a forward-facing lip 9 which extends from the bottom section of the support bracket 30, provides additional stability, and helps to counteract the force exerted on straps 10*a* and 10*b* upon disengaging the magnets. The lip 9 as well as the bottom section of the support bracket 30 does not have to be a continuous surface connecting the left side 30*a* of support bracket 30 to the right side 30*b* as depicted in FIG. 1B. Instead, it is possible that the lip 9 as well as the bottom section of the support bracket 30 only extend on each side to some distance less than halfway along the width of the sole, thereby resulting in the left side 30*a* and right side 30*b* as being two independent structural entities. This would enable the shoe manufacturer utilizing the fastening device 100 to produce the same support bracket 30 components regardless of the shoe width size, thereby affecting reduced manufacturing costs. The lip 9, along with the bottom section of the support bracket 30, is typically sandwiched between the inner sole 52 and mid sole 50 of the footwear, thereby maintaining the arms 30*a* and 30*b* of the support bracket in an upright position. A recessed portion may be pre-formed within the linings of the footwear such that the support bracket 30 is embedded within this "pocket" in order to precisely and securely position the support bracket 30 in the footwear. Such a design facilitates ease of manufacture and provides for improved comfort of the user. The support bracket 30 itself may be made of any material of suitable rigidity and mechanical strength such as a polymer, metal, metal alloy, or composite material. The left 34*a* and right 34*b* corners of the support bracket are preferably constructed of a material of sufficient rigidity, yet with enough elasticity to deform appreciably under application of an external force while still returning to its original shape once the force is removed.

Figure 2:
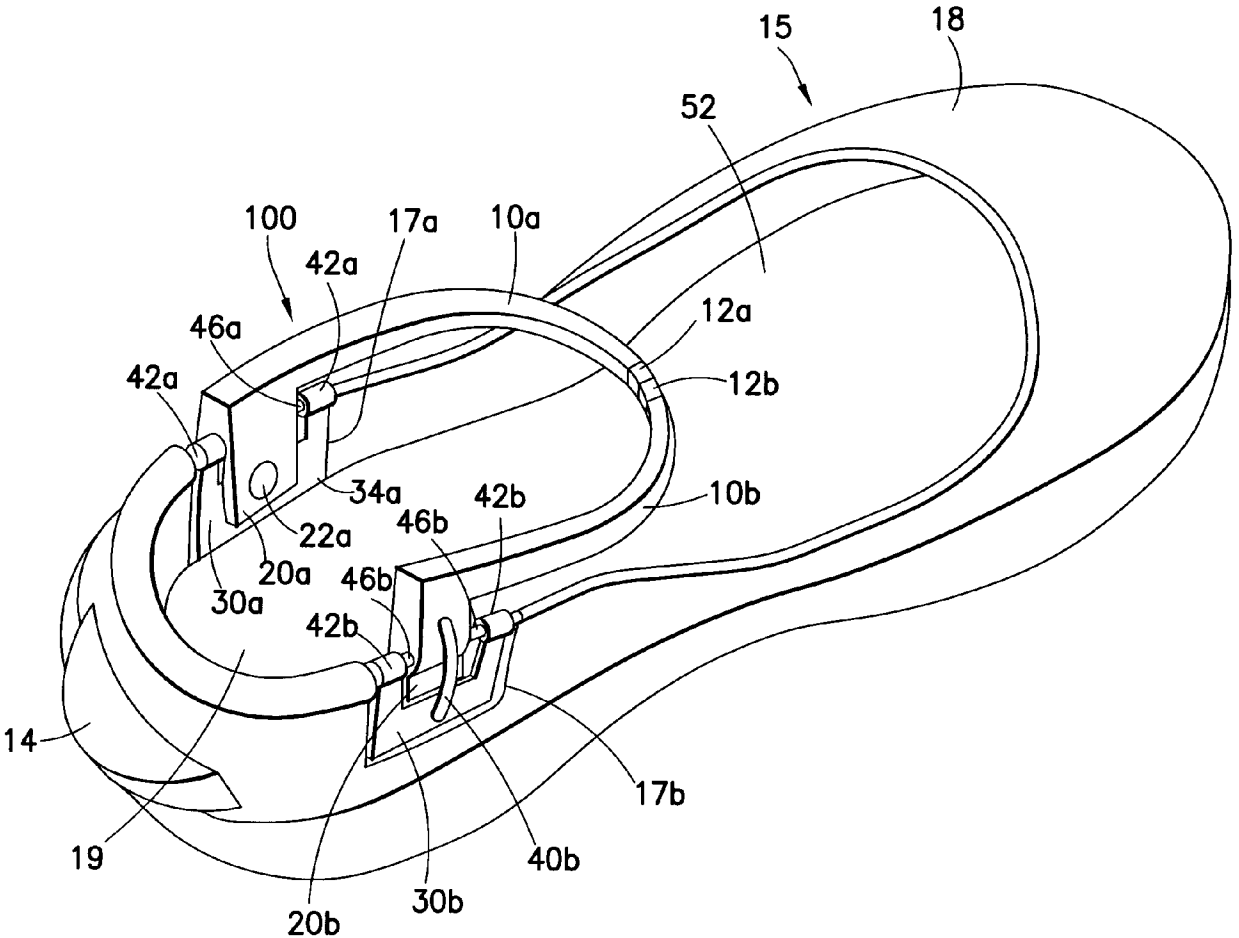
FIG. 2 is an illustration showing a perspective view of an actual shoe which incorporates the first embodiment of the fastening device.

A method of operating the hands-free fastening device will now be described with reference to FIG. 2 which shows an actual implementation of the fastening device 100 of FIGS. 1A-B within footwear 15. In the embodiment as shown, the footwear 15 has been designed such that cutout portions 17*a* and 17*b* accommodate operation of the fastening device 100. When the shoe is not in use, the fastening device 100 is normally maintained in an open position (dotted lines in FIG. 1A) by means of elastic members 40*a* and 40*b*, thereby permitting ease of inserting the user's foot. The footwear may be secured to the user's foot by means of a simple downward stepping motion.

This is accomplished by first having the user slide his/her toes into the front end 18 and then by bringing the heel of the foot down towards the base 19 of the footwear such that it comes into contact with and engages levers 20*a* and 20*b*. Continued downward pressure causes the levers 20*a* and 20*b* to move pivotally downwards about their respective hinge rods 46*a* and 46*b* while the straps 10*a* and 10*b* pivot upwards. Thus, when viewed from the rear (e.g., FIG. 1A), the left strap 10*a* and lever 20*a* rotate clockwise about hinge rod 46*a* whereas the right strap 10*b* and right lever 20*b* rotate counterclockwise about hinge rod 46*b*. Once the foot has traveled a sufficient distance downwards the three sets of mating magnets 32*a*-22*a*, 12*a*-12*b*, and 22*b*-32*b* will come into sufficient proximity with each other that there is an attractive force between each set of magnets of sufficient strength to snap the fastening mechanism 100 into the closed position, thereby securing the footwear to the user's foot.

The fastening mechanism 100 may be disengaged by performing the reverse of the above process. However, in this case, it may be necessary to immobilize the footwear such that it is not lifted up along with the foot and sufficient force can be applied to disengage straps 10*a* and 10*b*. This may be accomplished by using the opposing foot to press down on the heel of the footwear, thereby immobilizing it. The act of temporarily immobilizing the footwear at the heel may be facilitated by incorporation of a protruding member 14 which is securely fastened to or in the vicinity of the heel of the footwear, thereby providing a surface by which to immobilize the shoe. The straps 10*a* and 10*b* can be disengaged by lifting up the heel of the foot positioned in the footwear such that the attractive holding force between each of the magnet pairs 32*a*-22*a*, 12*a*-12*b*, and 22*b*-32*b* is broken and the straps 10*a* and 10*b* rotate outwards, thereby permitting the foot to be removed.

In a second hands-free method of releasing a user's feet from the apparatus 100, the user may apply a downward pressure to the ball of the foot to be released while simultaneously raising the heel. The user then applies a twisting motion to rotate the ankle such that pressure is applied to straps 10*a* and 10*b* in an amount sufficient to disengage the magnets and pull the foot upwards and out of the fastening mechanism.

Second Embodiment

Figure 3A:
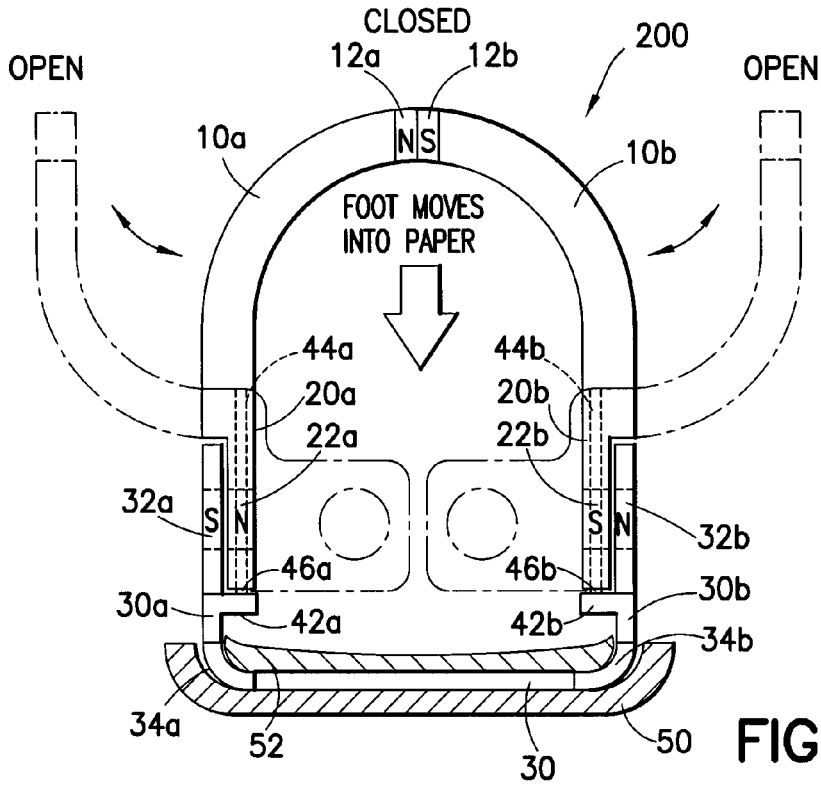
FIG. 3A is a cross-sectional schematic showing a rear view of a second embodiment of the fastening device which illustrates the basic mode of operation.

A second embodiment of the fastening device 200 will now be described in detail with reference to FIGS. 3A and 3B. The underlying principles governing operation of the second embodiment are similar to those presented above for the first embodiment, but the mechanics differ. Here, the hinge rods 46*a* and 46*b* are aligned approximately perpendicular instead of approximately parallel to the base of the support bracket 30 and the user's foot engages the levers by sliding forward instead of stepping downwards.

The fastening device 200 comprises components analogous to those disclosed for the fastening device 100 of the first embodiment. FIG. 3A is a rear view of the fastening device 200 showing the inclusion of left 10*a* and right 10*b* straps with corresponding left 20*a* and right 20*b* levers. The straps 10*a* and 10*b* are respectively secured to the left 30*a* and right 30*b* arms of support bracket 30 by means of hinge rods 46*a* and 46*b* which pass through hinges 44*a* and 44*b* and are secured at attachment points 42*a* and 42*b* located on the left 30*a* and right 30*b* arm, respectively.

The hinge rods are aligned approximately perpendicular to the base of the support bracket 30 (i.e., oriented approximately vertical with respect to the ground), thereby permitting the straps 10*a* and 10*b* to rotate between a closed (dark lines) and open (dotted lines) position. As shown by FIG. 3B, when in the closed position, the levers 20*a* and 20*b* are approximately parallel to each other and to the arms of the support bracket, 30*a* and 30*b*. Levers 20*a* and 20*b* are oriented at an angle with respect to the straps 10*a* and 10*b* (as viewed from above) such that when the foot is fully inserted into the footwear (i.e., the fastening device 200 is in the closed position) the straps 10*a* and 10*b* are fully engaged behind the Achilles tendon of the foot.

As is the case for the first embodiment, each strap and its corresponding lever comprise permanent magnets 12*a*-12*b*, and 22*a*-22*b* which are positioned at the distal ends of each individual strap and lever, respectively. The support bracket 30 further comprises permanent magnets 32*a* and 32*b* positioned approximately midway along the left 30*a* and right 30*b* arms of the support bracket, respectively, such that they are aligned with corresponding magnet 22*a* on the left 20*a* lever and magnet 22*b* on the right 20*b* lever when in the closed position. The fastening device 200 is therefore comprised of three sets of mating magnets positioned such that they have opposing polarities on a mating side. When the magnets are disengaged, the straps are maintained in the open position by any of a number of suitable means. This may be by a type of spring mechanism or by means of elongated elastic members as utilized in the first embodiment. The elasticity of the spring mechanism may be adjusted such that when the magnets are disengaged sufficient tensile force is applied to pull straps 10*a* and 10*b* apart and maintain them in the open position.

Figure 3B:
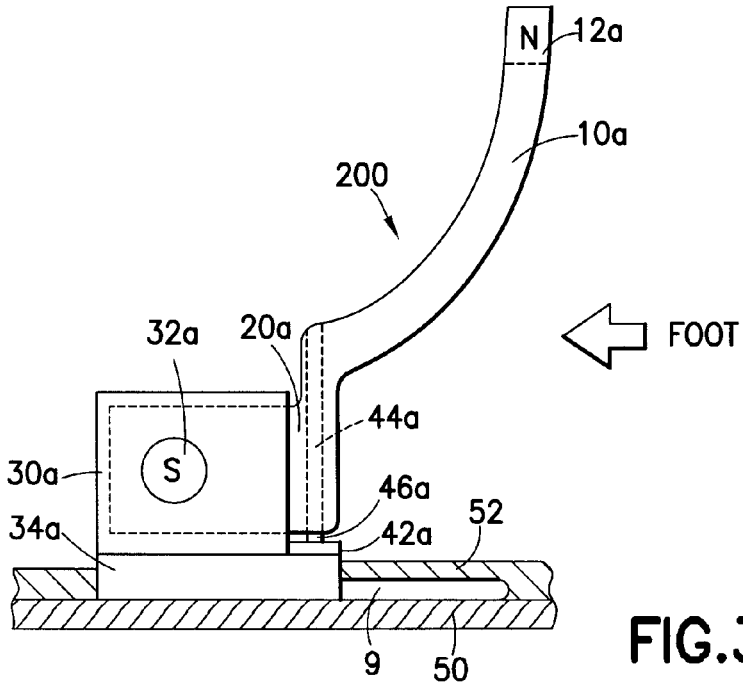
FIG. 3B is a schematic showing a side view of the second embodiment with the straps in a closed position.

A side view of the fastening device 200 is shown in FIG. 3B which illustrates that the support bracket 30 comprises a rear-facing lip 9 which extends from the bottom section of the support bracket 30. In this embodiment a rear-facing lip 9 is used in order to counteract the force exerted on rearward facing straps 10*a* and 10*b* upon disengaging the magnets. In a manner identical to the first embodiment, the lip 9 and bottom section of the support bracket 30 may be sandwiched between the inner sole 52 and mid sole 50 of the footwear, thereby maintaining the position of arms 30*a* and 30*b*. Also in a manner identical to the first embodiment and for the same reasons, the lip 9 and bottom section of the support bracket 30 may be split into two parts, thereby resulting in left support bracket 30*a* and right support bracket 30*b* being two independent structural entities.

A method of operating the second embodiment of the hands-free fastening device will now be described. In this embodiment the footwear is secured to the user's foot by means of a simple forward stepping motion. This is accomplished by merely having the user slide his/her toes into the footwear from the rear (see, e.g., FIG. 3A) such that the foot comes into contact with and engages the left 20*a* and right 20*b* levers. Continued forward pressure causes the levers to pivotally rotate forward about hinge rods 46*a* and 46*b* while the straps 10*a* and 10*b* rotate backwards. In this manner, when viewed from above, strap 10*a* and lever 20*a* rotate counterclockwise about hinge rod 46*a* whereas strap 10*b* and lever 20*b* rotate clockwise about hinge rod 46*b*. Once the foot has traveled a sufficient distance forward the three sets of mating magnets 32*a*-22*a*, 12*a*-12*b*, and 22*b*-32*b* will come into sufficient proximity with each other that there is an attractive force between each set of magnets of sufficient strength to snap the fastening device 200 into the closed position. In the second embodiment, the straps 10*a*-10*b* engage behind the user's ankle and above the heel in the vicinity of the Achilles tendon.

The fastening device 200 may be disengaged by performing the reverse of the above process. It will again be necessary to immobilize the footwear such that it does not move along with the foot and sufficient force can be applied to disengage straps 10*a* and 10*b*. This may be accomplished by pressing down on the sole of the footwear such that friction between the bottom of the sole and the ground does not allow the footwear to move. The act of immobilizing the footwear may be facilitated by using the other foot to block the footwear from sliding across the ground. The straps 10*a* and 10*b* can be disengaged by sliding the foot positioned in the footwear fully backwards such that the attractive holding force between each of the magnet pairs 32*a*-22*a*, 12*a*-12*b*, and 22*b*-32*b* is broken and the straps 10*a* and 10*b* rotate outwards, thereby permitting the foot to be removed.

Third Embodiment

Figure 4:
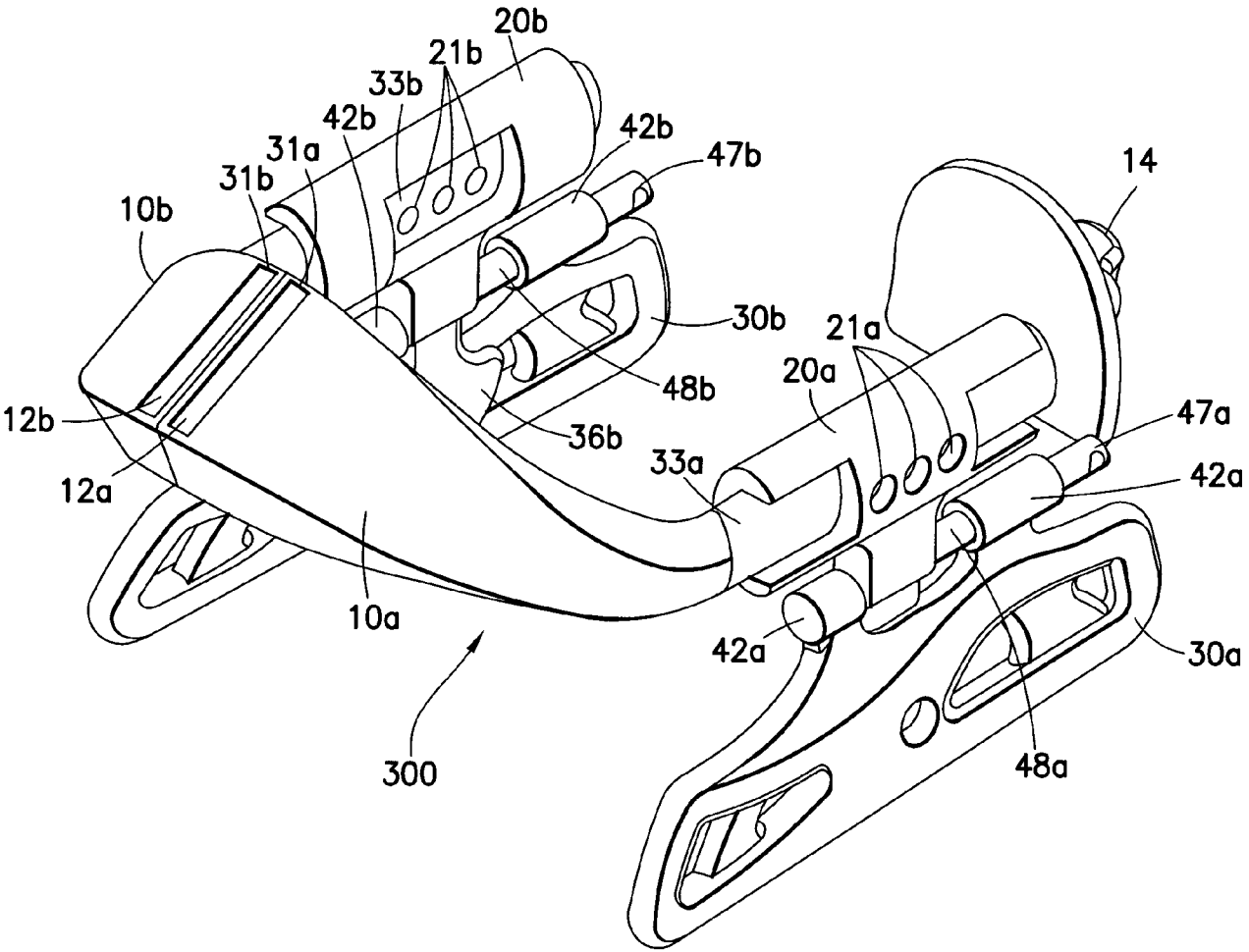
FIG. 4 is a perspective view of a third embodiment of the fastening device which is designed to be built directly into the shoe during manufacture.

A front perspective view of a schematic illustrating a third embodiment of the fastening device 300 is provided in FIG. 4. The fastening device 300 comprises a structure and operating mechanism similar to that provided in the first embodiment, but includes a number of additional design features. For instance, each strap 10*a* and 10*b* is attached to, but physically separate from the left 20*a* and right 20*b* levers. Additionally, each lever 20*a* and 20*b* may be removed from its corresponding support bracket 30*a* and 30*b* by disengaging interior hinge rods 48*a* and 48*b*, respectively. Finally, the support brackets 30*a* and 30*b* themselves are designed such that they may be built (i.e., permanently incorporated) into the footwear during manufacture.

FIG. 4 shows that the posterior ends of each strap 10*a* and 10*b* form oval cylinders 33*a* and 33*b*, respectively, which fit into and are capable of sliding through a matching bore situated at the top of the left 20*a* and right 20*b* levers. This configuration maintains the orientation of the straps 10*a* and 10*b* with respect to levers 20*a* and 20*b* while still permitting the user to laterally adjust the position of straps 10*a* and 10*b* for improved conformity to the user's foot by sliding it forward or backwards. The straps 10*a* and 10*b* may each be secured into the desired position by means of locking screws 21*a* and 21*b* which are located on the outside of each strap, thereby enabling adjustment of the position of the straps. This is further illustrated by FIGS. 5A and 5B which are exterior and interior side views, respectively, of the fastening device 300.

Figure 5A:
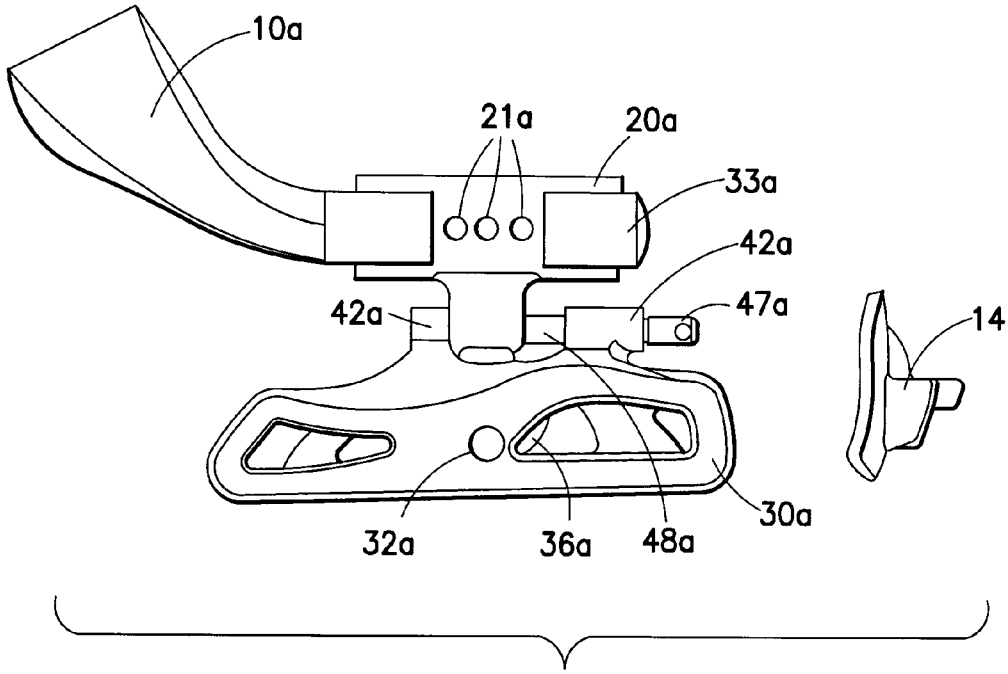
FIGS. 5A, 5B, 5C, and 5D are outside side, inside side, top, and front views of the third embodiment of the fastening device, respectively.
Figure 5B:
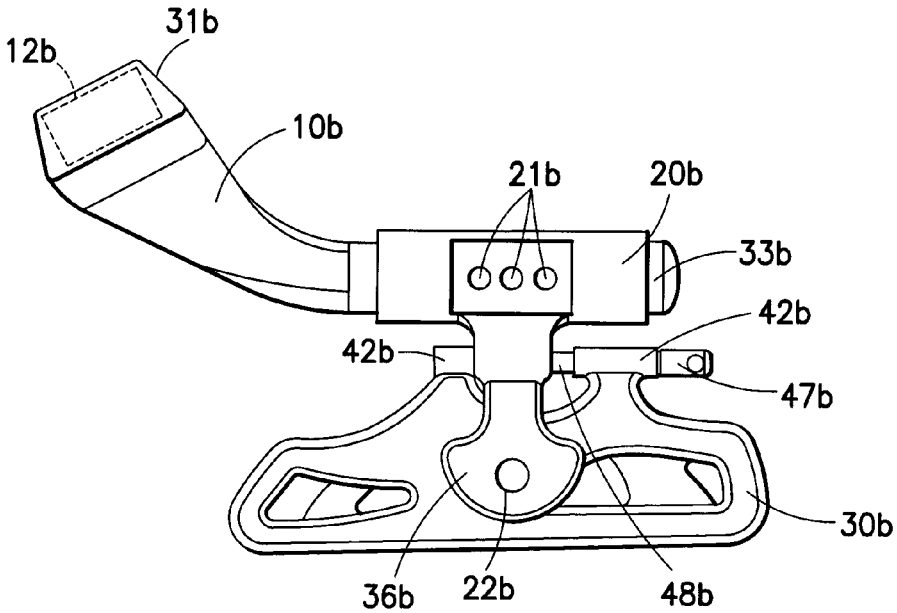
Figure 5C:
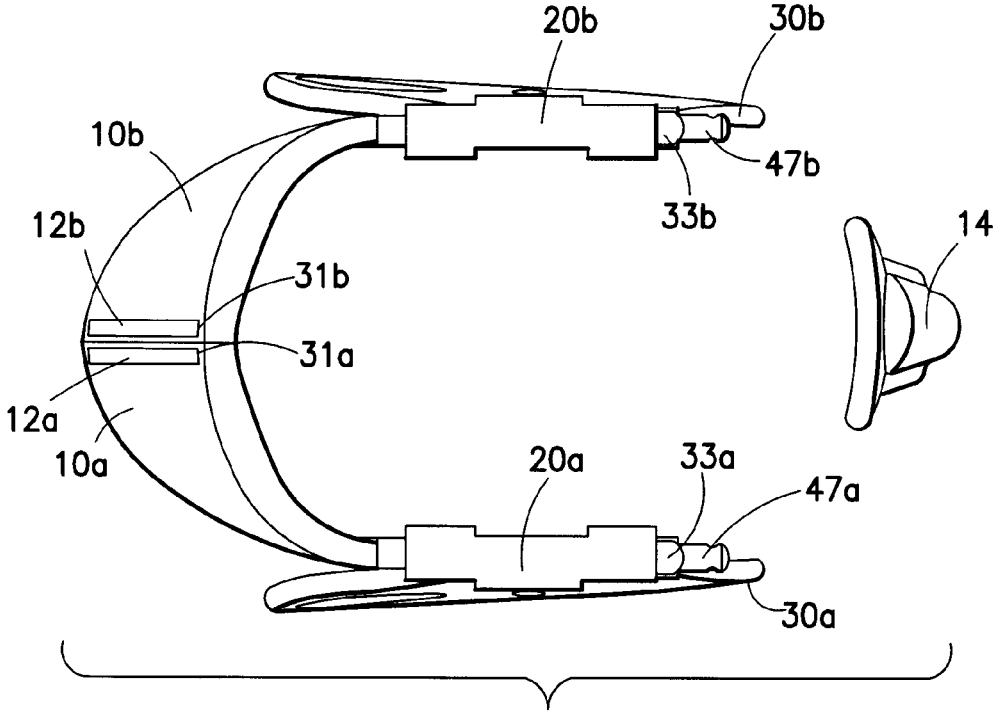
Figure 5D:
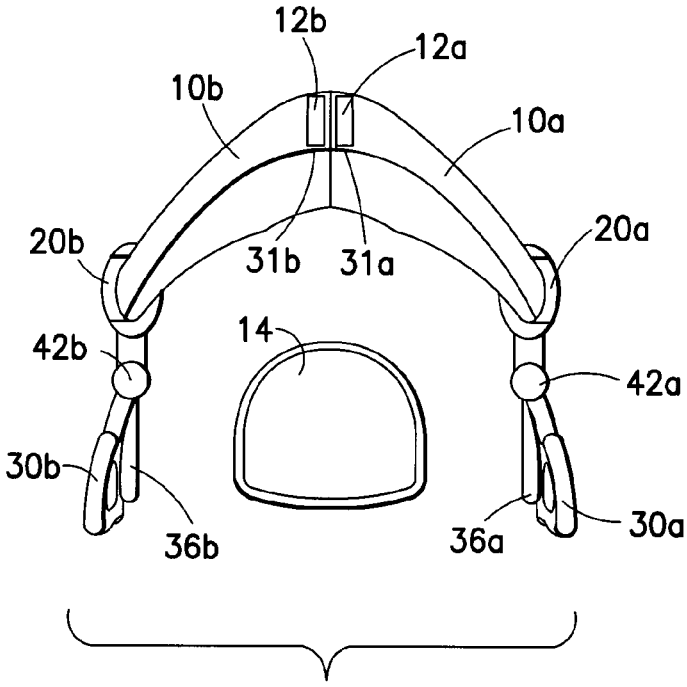
Figure 6:
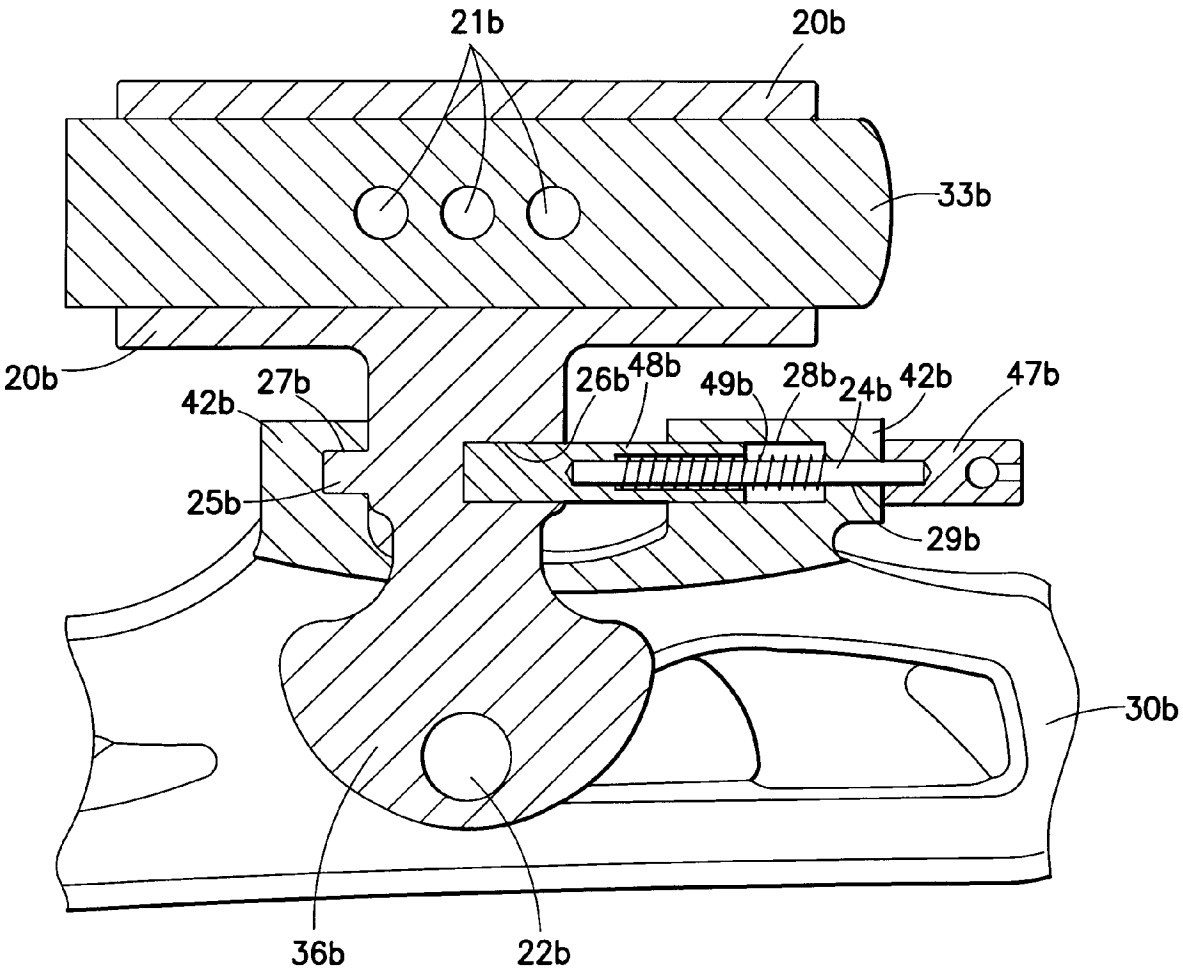
FIG. 6 shows the details of the hinge assembly used in the third embodiment.

As in the first embodiment, the distal ends of the straps 10*a* and 10*b* in the third embodiment comprise permanent magnets 12*a* and 12*b* which are oriented with opposite polarities on their mating sides. The magnets are held in place by means of pockets 31*a* and 31*b* which permit insertion and removal of magnets with differing strengths. In this manner the user is able to adjust the amount of force securing the straps in the closed position. Levers 20*a* and 20*b* are supplied with magnets 22*a* and 22*b* centrally located within crescent-shaped bottom segments 36*a* and 36*b* (see, e.g., FIG. 5B). Magnets 22*a* and 22*b* engage with corresponding magnets 32*a* and 32*b* (note that not all components are visible in FIGS. 4, 5A, 5B, 5C, and 5D) positioned on the left 30*a* and right 30*b* support brackets, respectively. Additional perspectives of the fastening mechanism 300 of the third embodiment are shown in FIGS. 5C and 5D which provide top and front views, respectively.

The levers 20*a* and 20*b* are each attached to its corresponding support bracket 30*a* and 30*b* at attachment points 42*a* and 42*b* by means of horizontally oriented interior hinge rods 48*a* and 48*b*. The hinge assembly permits each lever to rotate between an open and closed position. As is the case for the first embodiment, in the open position the crescent-shaped bottom segments 36*a* and 36*b* are aligned approximately perpendicular to support brackets 30*a* and 30*b* whereas in the closed position the crescent-shaped bottom segments 36*a* and 36*b* are approximately parallel to support brackets 30*a* and 30*b*. Furthermore, the straps 10*a* and 10*b* may be maintained in the open position when the magnets are not engaged by means of a suitably positioned elastic member or spring which connects the outside of each strap with the outside of a corresponding support bracket 30*a* or 30*b*.

A further distinction over the first embodiment is that each lever 20*a* and 20*b* may be removed from the support frame since interior hinge rods 48*a* and 48*b* are retractable. A cross-sectional schematic showing the details of the hinge assembly on the right support bracket 30*b* is provided in FIG. 6. Although not shown, an identical structure may be used on the left support bracket 30*a*. The hinge assembly comprises exterior 47*b* and interior 48*b* components which are secured to each other and attached to the support bracket 30*b* by a connecting shaft 24*b*. On one end, the interior hinge rod 48*b* is secured to the connecting shaft 24*b* which, in turn passes through hinge 29*b* before being secured to exterior hinge rod 47*b*. The inner hinge rod 48*b* is situated within a receiving bore 28*b* such that by grasping the outer hinge rod 47*b*, the user can slide the hinge rod from one end of the bore to the other.

A portion of the hinge assembly is formed on lever 20*b* as a protruding hinge member 25*b* and a hinge bore 26*b*. The lever 20*b* is secured to the support bracket 30*b* by first positioning the protruding hinge member 25*b* within a matching receiving bore 27*b* located at attachment point 42*b*. The lever 20*b* is then secured in place by inserting the interior hinge rod 48*b* into the hinge bore 26*b* located on the lever 20*b*. The interior hinge rod 48*b* is held against the lever 20*b* by means of a spring 49*b* located within the receiving bore 28*b*, between one end of the interior hinge rod 48*b* and the interior end of the receiving bore 28*b*. Thus, by grasping and pulling towards the rear of the shoe on the outer hinge rod 47*b*, the pressure exerted to hold the lever 20*b* in place is released and the lever 20*b* can be removed. Lever 20*b* can be reattached by performing the reverse of this process.

Figure 7A:
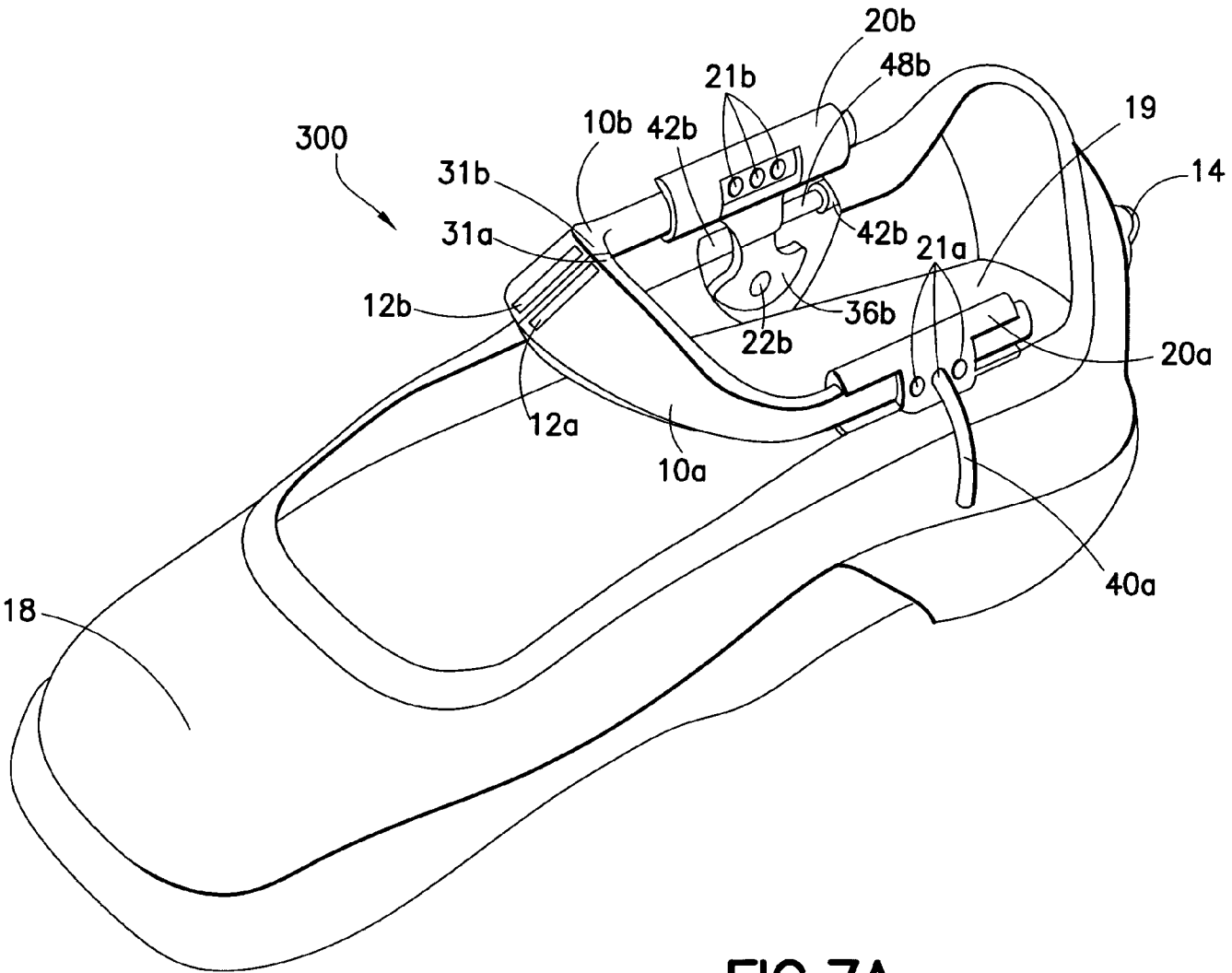
FIG. 7A is a schematic showing a perspective view of an actual shoe which incorporates the third embodiment of the fastening device.

The entire fastening mechanism 300 may be incorporated into the design and manufacture of nearly any type of footwear. An example is shown by FIG. 7A which is a schematic illustrating the implementation of the third embodiment of the fastening mechanism 300 within an article of footwear. The basic principles of operation are similar to, but not limited by those disclosed for the first embodiment with the additional features and advantages as discussed above.

Figure 7B:
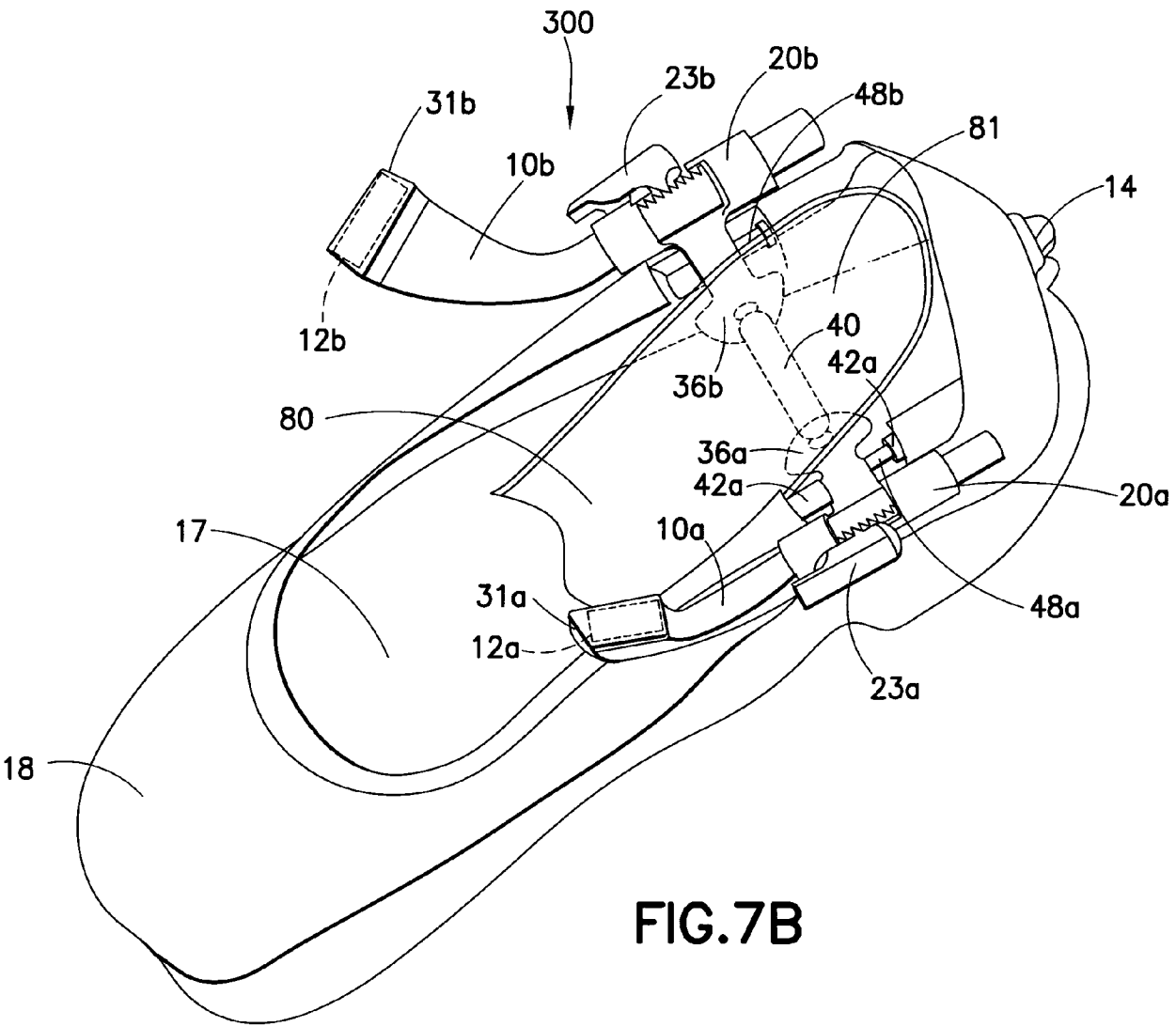
FIG. 7B is a schematic showing a perspective view of an actual shoe which incorporates the third embodiment of the fastening device with some alternative design features.
Figure 8:
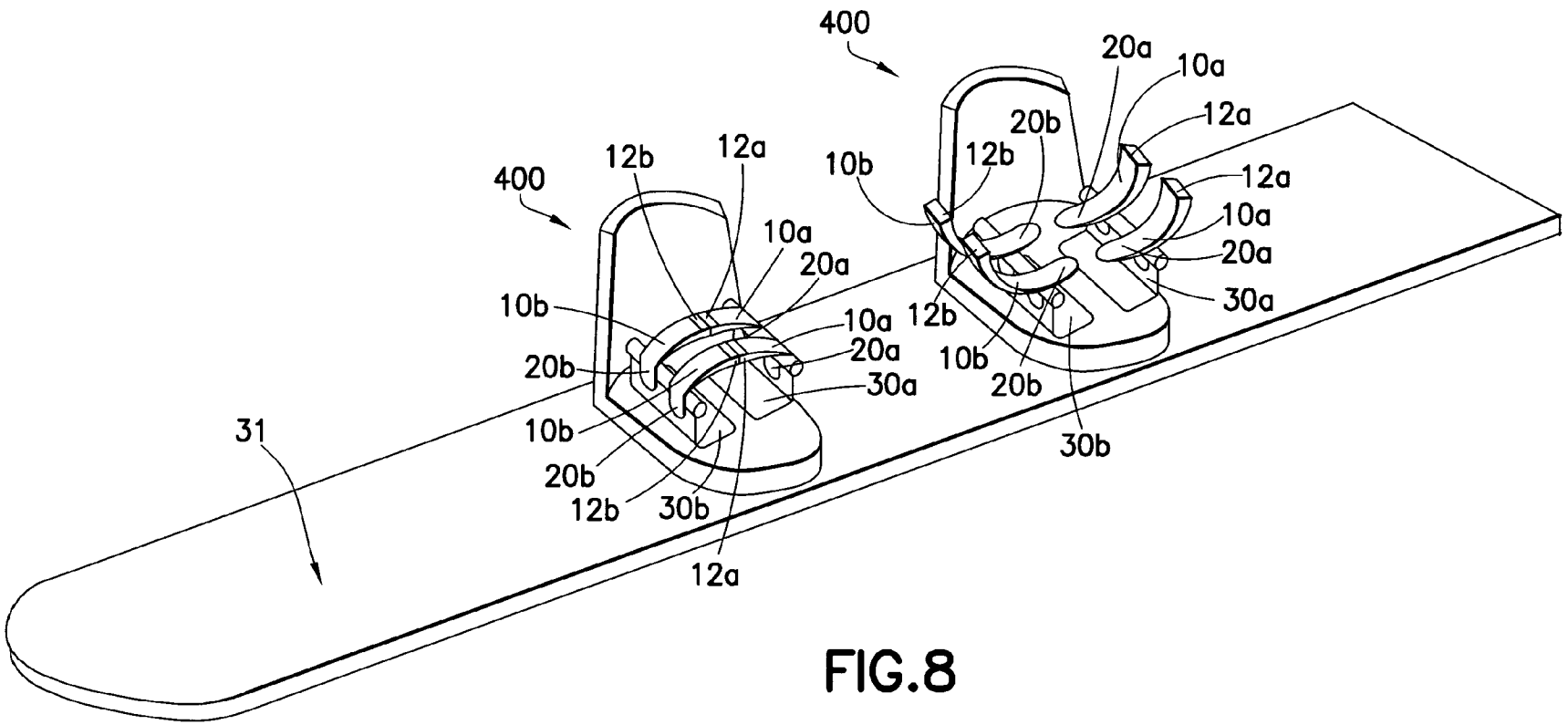
FIG. 8 is a sketch of the frontal perspective view of the fastening device utilized as a binding on a snowboard.

FIG. 7B depicts a front perspective view of a schematic illustrating the third embodiment with three alternative design features. The first design alternative introduces a flexible in-sole 80 as an additional element. The in-sole 80 is only attached to the main body of the shoe forward of the area of the arch 17 by any suitable means, such as adhesive. By doing so, a hinge point is thus created between the portion of in-sole 80 which is attached to the main body of the shoe and the portion that is not attached thereby enabling the heel portion of the in-sole 81 to rotate up and down. The heel portion of the in-sole 81 is positioned such that it is located above crescent-shaped bottom segments 36*a* and 36*b* when the device is in the open position.

With this modification, the operation of the fastening device 300 is altered as follows. The user slides his/her toes into the front end 18 and then brings the heel of the foot down towards the heel portion of the in-sole 81 such that it comes into contact with and engages crescent-shaped bottom segments 36*a* and 36*b*. Continued downward pressure causes levers 20*a* and 20*b* to move pivotally downwards about their respective interior hinge rods 48*a* and 48*b* while simultaneously elongating elastic member 40 and causing straps 10*a* and 10*b* to pivot upwards such that they engage and thereby secure the user's foot.

A second alternative design feature shown in FIG. 7B is the replacement of the locking screw (21*a* and 21*b*) arrangement for making adjustments to straps 10*a* and 10*b* with a ratchet and pawl arrangement as indicated in components 23*a* and 23*b* respectively, which allow for quick and easy forward and backward adjustment of the straps 10*a* and 10*b* by the user.

A third design alternative relates to the replacement of the elastic members 40*a* and 40*b*. In this embodiment, they are substituted by a single elastic member 40, which is attached between the two distal ends of crescent-shaped bottom segments 36*a* and 36*b* and stretches across the width of the shoe and underneath the in-sole 80 as the user steps down into the shoe. Also, as in the previously described embodiments, the elastic member 40 serves to maintain the fastening device 300 in the open position once the user removes his/her foot from the shoe.

Additional Application

An application which further exemplifies the advantages inherent to a user of the fastening device will now be described. This application involves the utilization of the fastening mechanism with foot bindings on a snowboard 31. An illustrative example of such an application is provided in FIG. 8. Here, two fastening mechanisms 400 of a type analogous to those disclosed in the above embodiments are used for each foot. By utilizing multiple fastening mechanisms, additional reinforcement is supplied to each foot to ensure that each is firmly secured to the snowboard 31.

The fastening mechanism itself may be attached to the snowboard by any suitable means (e.g., bolted down or attached via screws) and operates using the same principles as disclosed for the first through third embodiments. Thus, the user may individually secure each foot to the snowboard by applying a downward stepping motion which engages levers 20*a* and 20*b*, thereby rotating the straps 10*a* and 10*b* together such that they engage and thereby secure the user's foot.

However, the method of release is slightly different since, each foot is immobile when secured to the snowboard.

The user's foot can be removed from the apparatus by applying a downward force with one foot to immobilize the snowboard while simultaneously lifting up on the opposite foot such that the magnets are disengaged. The released foot can then be placed on any surface of the snowboard to immobilize the snowboard while simultaneously lifting up on the other foot to disengage the magnets, thereby permitting the user to remove the other foot from the snowboard. In this manner the user is able to quickly and easily secure and release each foot with the foot bindings via hands-free operation.

It will be appreciated by persons skilled in the art that the present disclosure is not limited to what has been particularly shown and described hereinabove. Rather, the scope of the present disclosure is defined by the claims which follow. It should further be understood that the above description is only representative of illustrative examples of embodiments. For the reader's convenience, the above description has focused on a representative sample of possible embodiments, a sample that teaches the principles of the present disclosure. Other embodiments may result from a different combination of portions of different embodiments.

The description has not attempted to exhaustively enumerate all possible variations. The alternate embodiments may not have been presented for a specific portion of the invention, and may result from a different combination of described portions, or that other undescribed alternate embodiments may be available for a portion, is not to be considered a disclaimer of those alternate embodiments. It will be appreciated that many of those undescribed embodiments are within the literal scope of the following claims, and others are equivalent.

What is claimed is:

1. A foot fastening device configured for use with an article of footwear comprising: a pair of pivotally movable straps; a pair of movable levers, each of which is coupled to one of the straps and is engageable by a part of a foot so as to cause the straps to move from an open position to a closed position when engaged by the part of the foot; and at least one catch on at least one of the straps in the pair positioned to releasably connect the pair of straps together.

2. The article according to claim 1, wherein the catch is at least one of a permanent magnet or a mechanical interlocking device.

3. The article according to claim 2, wherein the catch comprises a removable permanent magnet.

4. The article according to claim 1, wherein the strap is configured to pivot about an axis oriented approximately parallel to the sole of the footwear.

5. The article according to claim 1, wherein the strap is configured to pivot about an axis oriented approximately perpendicular to the sole of the footwear.

6. The article according to claim 1, wherein the straps are removable.

7. The article according to claim 1, wherein the levers are removable.

8. The article according to claim 1, wherein the foot fastening device comprises a protruding member attached to the footwear that can be used to immobilize the footwear when disengaging the catch.

9. The article according to claim 1, wherein the strap is adjustable with respect to the support bracket.

10. The article according to claim 9, further comprising a ratchet and pawl arrangement.

11. The article according to claim 1, wherein at least one pivotably movable strap comprises multiple pairs of straps with catches which engage with each other when in the second position.

12. The article according to claim 1, further comprising a catch located on the lever.

13. The article according to claim 1, further comprising a flexible insole positioned to engage the movable lever.

14. The article according to claim 1, wherein the footwear is an athletic apparatus.

15. The article according to claim 14, wherein the athletic apparatus is a snowboard.

16. An article for use with footwear comprising: a sole; a foot fastening device coupled to the sole, the foot fastening device comprising at least one pivotally movable strap; a support bracket coupled to the strap to allow the strap to move between a first position and a second position; a movable lever coupled to the strap which is positioned relative to the sole such that when engaged by a part of a foot, it will cause the strap to move from the first position to the second position; and at least one catch on at least one strap that, when engaged, will restrain the foot within the footwear and, when disengaged, will allow the foot to be removed from the footwear; and a flexible insole positioned to engage the movable lever, the flexible insole being positioned over the movable lever such that when a force is applied by the foot to the insole, the movable lever is engaged and causes the strap to move from the first position to the second position.

17. The article according to claim 16 wherein the movable lever comprises a pair of movable levers and further comprises a deformable member interconnecting one of the levers in the pair to the other of the levers.

18. A foot fastening device configured to be attached to an article of footwear comprising: at least one pivotally movable strap; a support bracket coupled to the pivotally movable strap to allow the strap to move between a first open position and a second closed position; a movable lever coupled to the strap and positioned such that when engaged by a part of a foot it will cause the strap to move from the first open position to the second closed position; at least one catch on at least one strap that, when engaged, will restrain the foot within the footwear and, when disengaged, will allow the foot to be removed from the footwear; and a biasing member that is operatively coupled to the movable lever and is configured to apply a biasing force to the lever to cause the strap to assume the first open position before insertion of the foot, wherein engagement of the foot with the lever overcomes the biasing force and results in the lever pivoting and the strap moving to the second closed position.

* * * * *